US005221215A

United States Patent [19]

Tan et al.

[11] Patent Number: 5,221,215

[45] Date of Patent: * Jun. 22, 1993

[54] USER CONFIGURABLE INTEGRATED ELECTRICAL CONNECTOR ASSEMBLY WITH IMPROVED MEANS FOR PREVENTING AXIAL MOVEMENT

[75] Inventors: Haw-Chan Tan; Nobbert N. H. Yu, both of Culver City, Calif.

[73] Assignee: Foxconn International, Inc., Sunnyvale, Calif.

[ * ] Notice: The portion of the term of this patent subsequent to Oct. 29, 2009 has been disclaimed.

[21] Appl. No.: 877,270

[22] Filed: Apr. 29, 1992

Related U.S. Application Data

[63] Continuation of Ser. No. 544,106, Jun. 26, 1990, abandoned.

[51] Int. Cl.[5] ..... H01R 13/66

[52] U.S. Cl. ..... 439/620; 333/185

[58] Field of Search ..... 439/608, 620; 333/181-185

[56] References Cited

U.S. PATENT DOCUMENTS

| | | | |
|---|---|---|---|
| 3,178,673 | 4/1965 | Krehbiel | 439/748 |
| 3,550,067 | 12/1970 | Hansen | 439/748 |
| 3,710,285 | 1/1973 | Schor et al. | 439/608 |
| 3,764,943 | 10/1973 | Koa | 439/607 |
| 4,020,430 | 4/1977 | Vander Heyden | 439/608 |
| 4,215,326 | 7/1980 | Hollyday | 439/608 |
| 4,222,626 | 9/1980 | Hollyday et al. | 439/608 |
| 4,265,506 | 5/1981 | Hollyday | 439/608 |
| 4,296,389 | 10/1981 | Fuller et al. | 29/600 |
| 4,376,992 | 3/1983 | Aizawa | 368/156 |
| 4,500,159 | 2/1985 | Briones et al. | 439/607 |
| 4,589,720 | 5/1986 | Aujla et al. | 439/620 |
| 4,653,838 | 3/1987 | Ney et al. | 439/620 |
| 4,660,907 | 4/1987 | Better | 439/620 |
| 4,679,013 | 7/1987 | Farrar et al. | 439/607 |
| 4,707,048 | 11/1987 | Gliha et al. | 439/620 |
| 4,710,710 | 12/1987 | Flora et al. | 165/11.2 |
| 4,804,332 | 2/1989 | Pirc | 439/620 |
| 4,846,732 | 7/1989 | Meelhuysen | 439/620 |
| 4,988,313 | 1/1991 | Castlebury | 439/621 |
| 5,057,041 | 10/1991 | Yu et al. | 439/620 |
| 5,112,253 | 5/1992 | Swift | 439/620 |
| 5,147,224 | 9/1992 | Tan et al. | 333/182 |
| 5,158,482 | 10/1992 | Tan et al. | 439/620 |

*Primary Examiner*—Gary F. Paumen
*Attorney, Agent, or Firm*—John J. Leavitt

[57] ABSTRACT

A user configurable integrated electrical connector assembly apparatus and method of using the electrical connector assembly to create a flexible manufacturing system are disclosed. The connector assembly is capable of being formed as a semi-finished product for inventory and at a later time may be simply and quickly reconfigured with insertable components to conform precisely to a customer's design specifications. The connector assembly includes a first insulator defining a plurality of first passageways, a second insulator defining a plurality of adjacent parallel passageways communicating with the first passageways over a portion of their length. A grounding plate has a plurality of through holes corresponding to the first passageways and is transversely to the passageways between the first and second insulators. Conductive shields surround the first and second insulators and contact the grounding plate. The shields are attached or bonded together to form a semi-finished product termed an insert assembly which may be stored in inventory. The insert assembly is easily and quickly reconfigured in accordance with a customer's design specifications by inserting chip type filter components such as a capacitor, varistor or other electrical component into selected second passageways.

12 Claims, 5 Drawing Sheets

USER CONFIGURABLE INTEGRATED ELECTRICAL CONNECTOR ASSEMBLY WITH IMPROVED MEANS FOR PREVENTING AXIAL MOVEMENT

This is a continuation of co-pending application Ser. No. 07/544,106 filed on Jan. 26, 1990, now abandoned.

BACKGROUND OF THE INVENTION

1. Field Of The Invention

The present invention relates to electrical connector assemblies and particularly to a user configurable connector assembly capable of being formed as a semi-finished product for inventory. The connector assembly later can be configured to the specific design requirements of a customer by the simple insertion of desired filter components, conductive members and associated contacts into selected passageways. The connector assembly includes an integrated filter component for filtering or suppressing the effects of electromagnetic interference or high frequency and radio frequency interference.

2. The Prior Art

Electromagnetic interference or high frequency and radio frequency signals are often radiated or conducted to susceptible electronic equipment and interfere with the performance of that equipment. Electromagnetic interference sources include sparks, lightning, radar, radio and TV transmission signals, brush motors and line transients. Additionally, a spark from a static discharge often is a source of electromagnetic interference.

By means of line conduction or even by propagation through the air, electromagnetic interference may induce undesirable voltage signals in electronic equipment. Such interference is especially prevalent at connection devices. The effects of electromagnetic interference may vary from mere static on a car radio, to a malfunction of an aircraft navigational system. Electromagnetic or high frequency interference may even result in incorrect readouts on sensitive medical diagnostic equipment.

Accordingly, it is extremely important to mitigate or to substantially eliminate the effects of electromagnetic or high frequency interference on a wide variety of instruments.

Due to the multitude of sensitive electronic devices that may be adversely affected by electromagnetic or high frequency interference, there is an increasing need for electrical connectors that provide good filtering capability over a wide range of conditions and uses. There is also a need for an electrical connector which may be user configurable in order to adapt to a wide variety of interfaces for connecting together different electrical devices with a minimum of interference.

What is also needed is a filtering connector capable of being formed as a semi-finished product to be stored as inventory by a manufacturer. This would enable, at a later time, large numbers of contacts to be assembled with desired filter components so that the connectors may be quickly and simply adapted for a particular use in a wide variety of electrical devices in accordance with a customer's instructions.

With regard to filtered connector assemblies, the prior art is characterized by basically four types. The first type of filtered electrical connector employs a monolithic planar capacitor for engaging each electrical contact axially. Examples of this type of electrical connector would include the following: U.S. Pat. No. 4,376,992, U.S. Pat. No. 4,589,720, U.S. Pat. No. 4,653,838, or U.S. Pat. No. 4,710,710.

A second type of electrical connector is characterized by a series of axial contacts and corresponding apertures for coupling the contacts. Each aperture has a capacitor attached around its circumference. The axial contact is inserted through the capacitor. An improvement of this prior art type employs a tubular sleeve capacitor for receiving electrical contact. Examples of this type of filter would include U.S. Pat. No. 3,710,285, U.S. Pat. No. 3,764,943, U.S. Pat. No. 4,020,430, U.S. Pat. No. 4,215,326, U.S. Pat. No. 4,222,626, U.S. Pat. No. 4,265,506, U.S. Pat. No. 4,296,389, U.S. Pat. No. 4,679,013, or U.S. Pat. No. 4,846,732.

A third type of prior art filtered electrical connector uses a "chip" type capacitor to couple with the contact. Examples of this type would include U.S. Pat. No. 4,500,159, U.S. Pat. No. 4,804,332, or U.S. Pat. No. 4,880,397.

A fourth type of filtered electrical connector of the prior art utilizes a so called "array" type capacitor which provides a planar filter associated with a series of corresponding axial contacts.

There are significant disadvantages associated with prior art filtering electrical connectors. For example, the "array" filters are expensive and somewhat complicated to manufacture. The "feed through" filters using tubular capacitors suffer from problems of strain and deformation due to vibration and applied compressive forces. Because the capacitor contacts must be individually soldered or bonded to a conductive plate, this increases the expense of assembly. The tubular type capacitors also are subject to breakdown due to their fragility and are therefore unsuitable for use in harsh operating environments, such as in motor vehicles, aircraft, or the like, where components will be subject to extreme temperature and vibration. As to the monolithic planar filters, these are also subject to similar limitations due to their relatively delicate structures.

For the above reasons, the present invention adopts the "chip" type or integrated filter component. Chip type filter components are inexpensive compared to other types of filters, and also possess a more rugged structure.

There are two basic kinds of prior art connectors employing chip type filter components. Examples of these types are illustrated by U.S. Pat. No. 4,500,159 and U.S. Pat. No. 4,804,332. In both patents, a series of cavities are disposed above and transversely to the axis of the contact. Chip capacitors or other chip components are then disposed in each cavity from above. Each chip directly touches an associated contact at a right angle. Thus, each capacitor has a direct contacting relation with the contact. This can result in damage to the capacitor if the contact is inserted roughly into the cavity. The direct connection between the contact and the capacitor disposed in a transverse relation may also result in the direct transmission of torsional forces or rotational movement from the contact to the capacitor. This can damage the electrode of the capacitor, or can degrade or destroy entirely the continuity of the electrical contact between the capacitor and the contact.

The prior art has the additional disadvantage that the chip capacitors must be permanently placed into the internal portion of the connector before final assembly so that the connector will be functional. Thus, in the prior art, it is not possible to manufacture the connector assembly as a semi-finished product and later insert components to configure the finished product in accordance with a customer's design specifications. For example, in U.S. Pat. No. 4,500,159 all the chip capacitors are assembled in a row of cavities in a bus bar. A discrete capacitor is placed in each cavity and in direct communication with the contact, the contact being a pin, socket or the like. In addition, a one-piece spring member includes a plurality of spring tines, each having a portion disposed in a cavity for holding the chip capacitor in an electrically contacting relation with the contact. The one-piece spring member presses all the capacitors into a direct contacting relation with the contact. The one-piece spring member also provides the function of ground the capacitors as well as maintaining them in electrical communication with the contact. This is disadvantageous because prior to final assembly of the electrical connector, each chip capacitor must be in place in a respective cavity. This limits the connectors to a few predetermined shapes and completely eliminates the possibility of user configurability in accordance with each customer's own design specifications.

U.S. Pat. No. 4,804,332 also provides a row of chip receiving cavities in a bus bar. The cavities are also arranged transversely to the axis of the terminal contact. A contacting member must communicate with the contact and with each capacitor or chip-type component individually. Further, each capacitor is preferably soldered or otherwise fixedly bonded in its respective cavity. This also has the disadvantage that the connector configuration is inherently inflexible. The capacitors must be configured as a single row in a bus bar. Additionally, an entire row of capacitors must be inserted at the same time into the bus bar and soldered, welded or otherwise fixedly bonded within the cavities. This precludes a flexible manufacturing system which would enable each connector to be customized or configured in accordance with the user's unique design. Because the prior art fixes the capacitors in a predetermined configuration into the internal portions of the connector assembly prior to final assembly of the connector, it is impossible to thereafter alter the configuration in order to conform to a customer's exact requirements.

This is a serious disadvantage in the prior art, because a customer such as a computer manufacturer, must be forced to use an inappropriate connector configuration or be forced to modify its own design specifications in order to conform to an available connector assembly. This is a wasteful practice and results in connectors which are not adequately suited to the customer's design specifications for the needs of the system and accordingly do not perform filtering functions as adequately as they should.

The prior art devices also have the disadvantage that the manufacturer of the electrical connectors must receive instructions from the customer before the product can be fabricated and assembled. This disadvantageously results in a long lead time with respect to the customer. Any delay in manufacturing of the connector assemblies can severely upset the predetermined schedule of the customer if the connectors are to be a component of the final product, such as a computer.

Another problem results when the manufacturer of electrical connectors must fabricate and store large numbers of filter connectors having many types of configurations and differing design requirements in order to be prepared to meet the needs of the customers. While this can avoid the disadvantage of a long lead time, it nevertheless results in problems in keeping track of a large inventory and may also result in a considerable amount of frozen capital investment.

Therefore, in the prior art, many different filter components must be permanently bonded to contacts or otherwise assembled as a finished product or held in storage in order to anticipate the needs of a customer. This results in the added expense of keeping large quantities of filter connector components or a great variety of electrical connectors in inventory in order to meet a customer's anticipated demand. Also, a customer often may be forced to use an electrical filter which merely approximates its needs and thus adversely affects the function and cost of an entire apparatus.

In the prior art, an electromagnetic shield is generally provided by a screen or other conductive housing placed around devices or circuits to reduce the effects of both electric and magnetic fields on the devices being connected. The electromagnetic fields result from the presence of a rapidly changing electric field and its associated magnetic field. Shielding from the electromagnetic interference is a combination of reflection and absorption of electromagnetic energy by the material. Reflection occurs at the surface of the material much like the reflection of light at an air-to-water interface, and is not usually affected by shield thickness. Absorption, however, occurs within the shield and is highly dependent upon thickness.

Another disadvantage inherent in prior art connector devices is the failure to minimize distances between a filtering means such as a capacitor and the connection between the terminal contact and ground. This increases the probability of stray inductances and renders many prior art filter connectors completely unsuitable for use in precision electrical instruments. Prior art devices also suffer from a failure to maximize the area connecting complete ground with the terminal contact and the filtering device.

SUMMARY OF THE INVENTION

In order to overcome the foregoing disadvantages of prior art filtered electrical connectors, it is an object of the present invention to provide a user configurable integrated connector assembly at a greatly reduced cost which nevertheless achieves a greater capacity for filtering out electromagnetic interference or stray high frequency signals.

Another object of the invention is to provide a user configurable integrated electrical connector assembly wherein all parts may be assembled as a semi-finished product with the exception of the contacts and associated filter components. After receiving the customer's instructions, the producer then simply inserts the selected integrated electrical filter components and the contacts into the semi-finished product in accordance with the customer's precise specifications.

The invention provides an improved electrical connector produced in accordance with a flexible manufacturing system. The electrical connector can be made as a semi-finished product to be stored as inventory and then easily configured with a plurality of freely receivable components to adapt to a practically infinite number of specific applications. This eliminates the need for expensive welding, soldering or otherwise fixedly bonding components. This also advantageously provides an interference free connector capable of interfacing a wide variety of electrical components in accordance with each customer's own design specifications.

In accordance with these and other objects, the invention provides a user configurable, integrated electrical connector assembly comprising an insulated body including a first insulator and a second insulator, respectively, each defining a plurality of first passageways extending therethrough for receiving a corresponding electrical terminal contact. The second insulator furthermore defines a corresponding number of second passageways extending therethrough. Each second passageway is parallel to and communicates with a first passageway over a portion of its length. Each second passageway has an open end for receiving a corresponding integrated electrical component, such as a capacitor. A grounding plate is disposed between the first and second insulators and oriented transversely to the long dimension of the first passageways. The grounding plate has corresponding openings for mating with the first passageways and a series of embossments, each extending into the terminal end of an associated second passageway. A conductive shield for shielding against electromagnetic interference covers the insulators and electrically couples with the grounding plate.

In accordance with a customer's design specifications, a number of desired chip-type filter components are inserted in selected ones of the second passageways. A selected number of contacts are disposed in the corresponding juxtaposed first passageways. A corresponding number of electrically conductive members are disposed individually in the second passageways behind and resiliently abutting the electrical filter components. Each electrically conductive member is adapted for fixedly positioning and stabilizing an associated electrical filter component and holds the component firmly without welding or bonding to make the electrical communication between the electrical filter component and the contact. Each electrically conductive member also maximizes the degree of electrical communication between the filter component and the contact. At the same time, each electrically conductive member provides a means for preventing the transference of torsional forces or axial movement from the contact to the electrical component.

The user configurable integrated electrical connector assembly further includes a flexible manufacturing system. A connector assembly may be assembled and stored as a semi-finished product. At a later time, and according to a customer's instructions, the producer can insert the desired electrical filter component corresponding to the customer's predetermined configuration into selected second passageways, then insert the electrically conductive member behind each electrical component to fixedly position it in the same passageway. In a final step, the contacts are inserted into the first passageways. The invention together with further objects and attendant advantages, will be best understood with reference to the following detailed description taken in conjunction with the accompanying drawings.

DETAILED DESCRIPTION OF THE INVENTION,.

Figure 1:
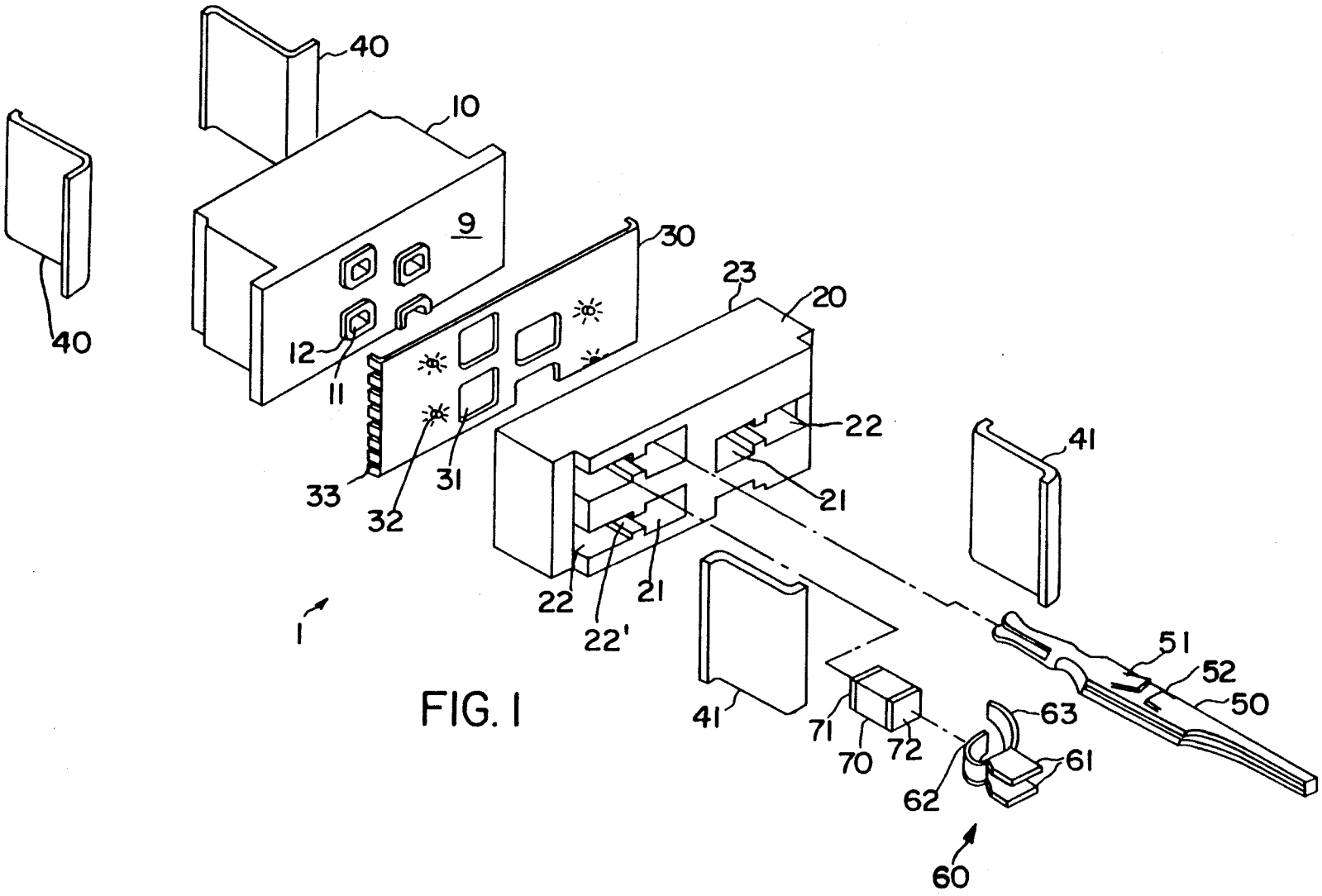
FIG. 1 is a perspective view in exploded form of a presently preferred embodiment of the user configurable integrated electrical connector assembly of this invention and illustrating the individual parts arranged in relation to a longitudinal axis.
Figure 2A:
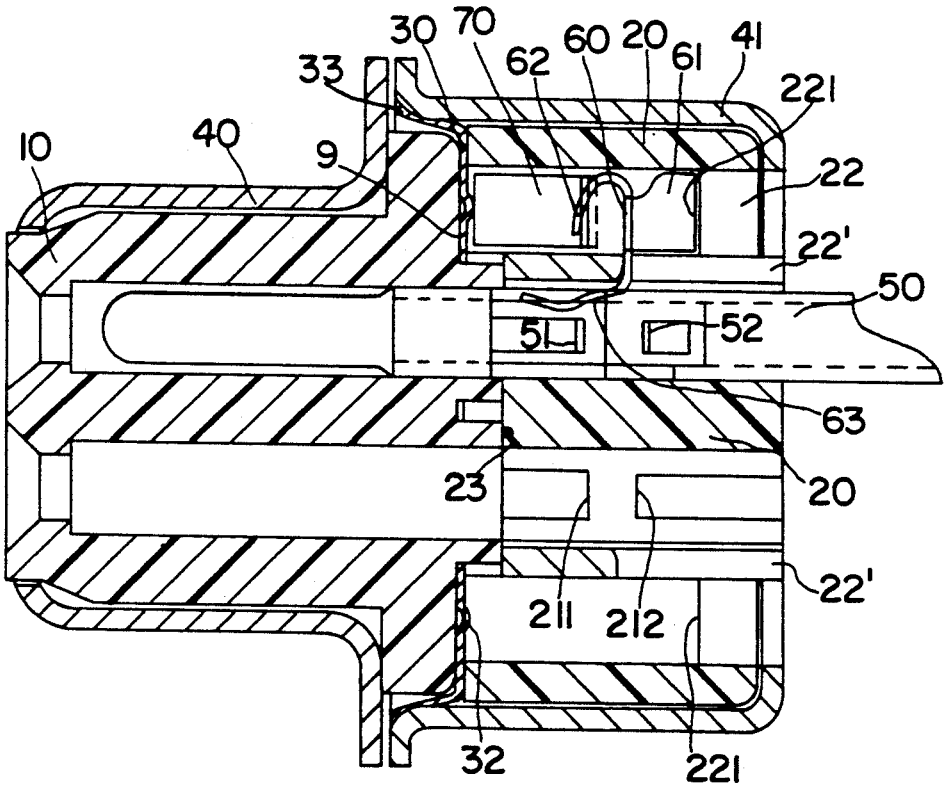
FIG. 2A is a vertical sectional view of the assembled connector of FIG. 1 rotated 90° counterclockwise about the longitudinal axis of the connector.

Referring now to FIGS. 1 and 2A, the subject connector designated generally by the number 1 includes an insulated body comprising a front insulator 10 and a rear insulator 20. A plurality of first passageways 11, 21 extend axially through the front insulator 10 and the rear insulator 20, respectively. A plurality of second passageways 22 extend through the rear insulator 20, and are parallel to and communicate with the first passageways 21 through an opening therebetween extending along a portion of the length of the passageways. A grounding plate 30 is disposed between the front insulator 10 and the rear insulator 20. A plurality of openings 31 and embossments 32 are disposed in the grounding plate 30 and correspond to the first passageways 21 and the second passageways 22, respectively. Grounding plate 30 is electrically coupled to a conductive shield 41 by a connection means. In, a preferred embodiment, the connection means comprises integral, tabs 33 as shown in FIGS. 1 and 2A disposed on the opposite outer lateral edges of grounding plate 30. A conductive shield 40 covers the front insulator 10 and conductive shield 41 covers the rear insulator 20. The shields 40 and 41 are coupled together by any suitable attachment means to provide a direct electrical connection with ground through grounding plate 30.

An advantage of the preferred embodiment is provided by the transverse perpendicular orientation of the grounding plate 30 and lateral spacing of the conductive 41 and 42, in relation to the passageways 21 and 22, respectively containing the contact 50 and the filter component such as chip capacitor 70 as shown FIGS. 1 and 2A. The provision of the grounding plate 30 between the front and rear insulators 10 and 20, respectively, functions to separate and shunt to ground the passing of interfering signals in and out of the connector body and therefore provides an extremely good shielding effect. The combination of the grounding plate 30 and laterally spaced conductive shields 40 and 41 provides an extremely effective shielding against an electromagnetic interference by a combination of reflection and absorption of electromagnetic energy. Reflection occurs at the surface by conductive shields 40 and 41. Absorption occurs within the grounding plate 30.

The grounding plate 30 is advantageously maintained in extremely close proximity with every contact 50. That is, the distance to complete ground provided by grounding plate 30 is minimized by the transverse perpendicular orientation of the grounding plate 30 in relation to the long dimension of the passageways 21 and 22 and its location in the center of the connector body between the front and rear insulators. This provides an improved, more complete grounding effect than is generally possible in the prior art.

For example, in the prior art the grounding effect is often provided by screws placed at opposite sides of a connector. The prior art disregards the distance between the filtering capacitor 70 and complete ground as well as distance between the contact and complete ground. Therefore, the distance to complete ground is often considerably longer than in the present invention. This increases the probability of stray inductances that may cause significant interference. The present invention therefore provides the advantage of preventing or substantially reducing the chance of stray inductances by maximizing the area of the grounding plate 30 and by minimizing the distance between the filtering components 70, the contact 50 and complete ground.

Contacts 50 are disposed in the passageways 11, 21. The contact 50 is composed of a conductive material and has a cylindrical cross-section in a first end portion and a square cross-section in a second end portion. The first end portion extends conformably within the passageway 11 in front insulator 10 and the second end portion rests conformably within the passageway 21 of rear insulator 20.

Figure 2B:
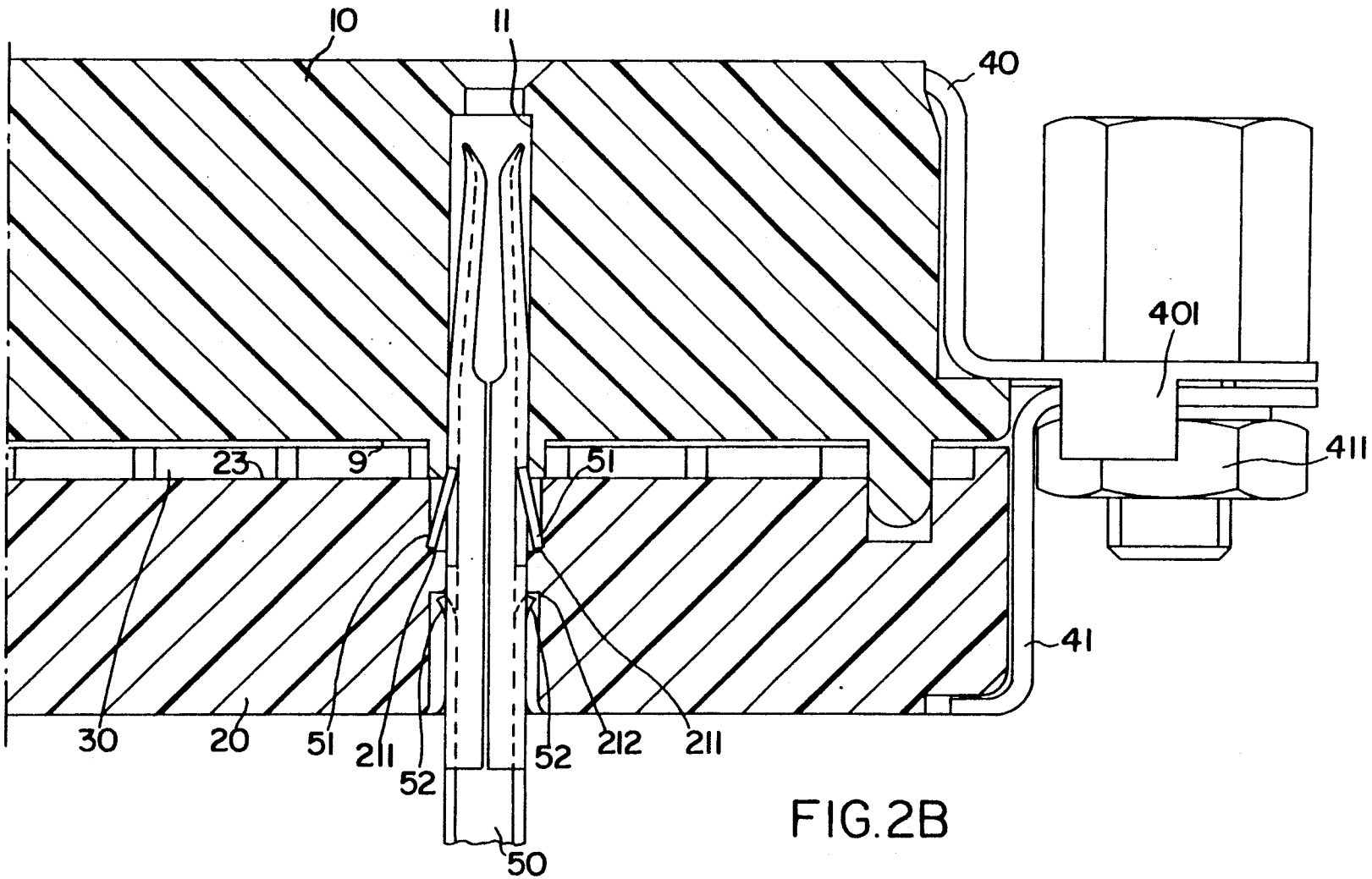
FIG. 2B is a fragmentary horizontal sectional view of the connector of FIG. 1 in assembled form.

In the second end portion of contact 50, there is a rearwardly extending angular protrusion 51 on opposite side walls thereof as best seen in FIG. 2B. Angular protrusion 51 has a resilient or elastic character. Another pair of forwardly extending protrusions 52 are also provided on the same side walls of contact 50. As shown as in FIG. 2B, there are two pairs of steps 211, 212 in the rear insulator 20 which correspond to and confront the pair of angular protrusions 51 and 52, respectively, in order to retain the contact 50 in a proper location. With regard to the protrusion 52, its angular extension is slightly smaller than the width of the passageway 21 to facilitate the ease of insertion into passageway 21 and to reduce friction and danger of damaging the contact.

Figure 3:
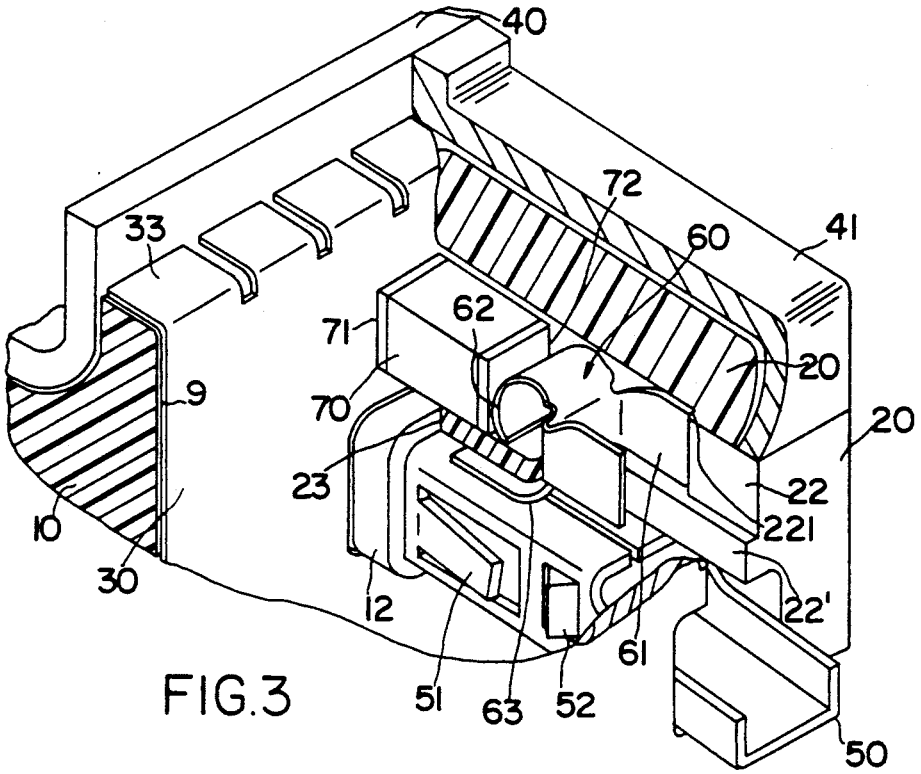
FIG. 3 is a cutaway perspective top view of the electrical contact, the capacitor, and the conductive member.

A chip capacitor or other integrated filter component 70 is inserted into the open receiving end of the rear insulator second passageways 22 as shown in FIGS. 1, 2A and 3. Referring to FIG. 3, it will be appreciated that steps 221 in passageway 22 confront each distal end of "U" shaped portions 61. Only one step 221 is shown in FIG. 3 for clarity. The "U" shaped portions 61 of conductive member 60 are also somewhat resilient and once they are compressed and extended past the steps 221 in the passageway 22, they spring outwardly by virtue of their resilience to confront the steps 221. This advantageously prevents any rearward movement or axial twisting of the conductive member 60, since the sides of "U" shaped projections 61 fill the entire space of passageway 22 and the ends thereof confront the steps 221 along their entire width. This maximizes the stability of the conductive member 60 and enhances electrical communication between the chip capacitor 70 or other filter component and the contact 50 as will be further explained.

Referring again to FIGS. 1 and 4, it will be appreciated that flanges 12 are disposed on the surface 9 of the front insulator 10 which is to be contiguous with the grounding plate 30 when the connector is assembled. Each flange 12 is an integral projection of the insulator material which forms insulator 10. Each flange 12 fits conformably within a corresponding opening 31 of grounding plate 30. The flanges 12 function to ensure that the contact 50 does not touch the grounding plate 30 directly. That is, the contact 50 will only connect with the grounding plate through the electrically conductive member 60 and chip capacitor 70 or other filter element. This has the advantages of maximizing the surface area of electrical communication between the contact 50, the chip component 70 and grounding plate 30. This also has the advantage of preventing the buildup of stray inductances between the contact and the grounding plate. Because each electrical contact 50 is completely surrounded by the insulator 10 and insulator flange 12, this provides a greatly improved insulative shielding to substantially eliminate the radiation of stray high frequency signals.

As seen in FIGS. 1 and 3, the unique configuration of the electrically conductive member 60 firmly holds the integrated filter component such as chip capacitor 70 in invariant electrical communication with grounding plate 30 and with the contact 50. This facilitates the formation of a user configurable, flexible manufacturing system. That is, the chip capacitor 70 or other filter component may be freely, inserted into the passageway 22 of the connector assembly 20 without welding, soldering, or other forms of bonding. The conductive member 60 is inserted behind the chip capacitor or other component 70, as will be explained.

The conductive member 60 is configured to provide a maximized degree of electrical communication between the grounded electrode or end surface 71 of chip capacitor 70 and contact 50. The contacting surface of resilient projection 62 of conductive member 60 rests firmly against the electrode surface 72 of chip capacitor 70 as shown in FIGS. 1 and 3. At the same time, the other electrode surface 71 of chip capacitor 70 is pressed firmly and resiliently against a corresponding embossed area 32 of grounding plate 30. The embossment 32 eliminates non-conformities or air pockets that could otherwise develop between the grounding plate 30 and electrode end 71 of chip capacitor 70. That is, the embossment 32 provides a maximized electrical contact between the grounding plate 30 and the electrode surface 71 of chip capacitor 70. The conductive member 60 thus fixes the chip capacitor 70 in a stable and invariant electrical communication with the embossment 32 of grounding plate 30.

Figure 4A:
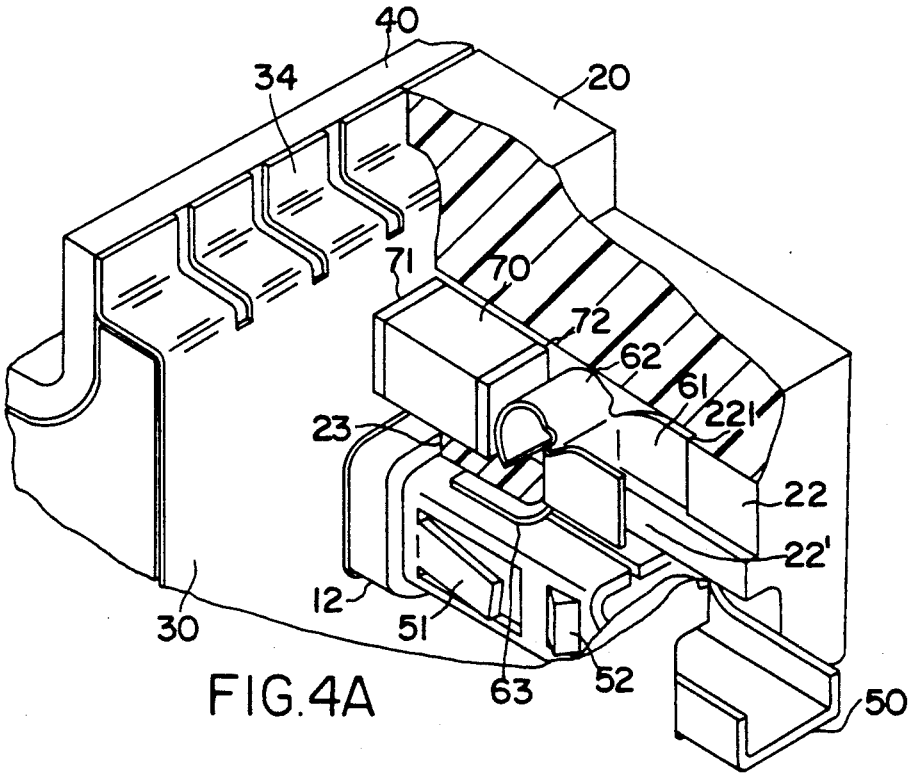
FIG. 4A is a cutaway perspective top view of the electrical contact, the capacitor, and the conductive member of the embodiment of FIG. 4.

Conductive member 60 also functions to maximize the degree of electrical communication with contact 50. It will be appreciated that the extension portion 63 of conductive member 60 is curved outward toward the associated and parallel passageway 21 and prior to insertion of the contact 50, the extension portion 63 penetrates the passageway 21 through the opening 22' therebetween and has a resilient character. Extension portion 63 is engaged and flexed inwardly when contact 50 is inserted and presses resiliently against the top surface of contact 50 as shown in FIGS. 1, 3 and 4A. This configuration of extension portion 63 provides additional resilient pressure against contact 50 to hold the contact firmly. The electrical communication between the contact member 50 and the chip capacitor 70 also is maximized by means of the constant pressure exerted against the top surface of contact 50 by the curved and resilient extension portion 63.

Figure 4:
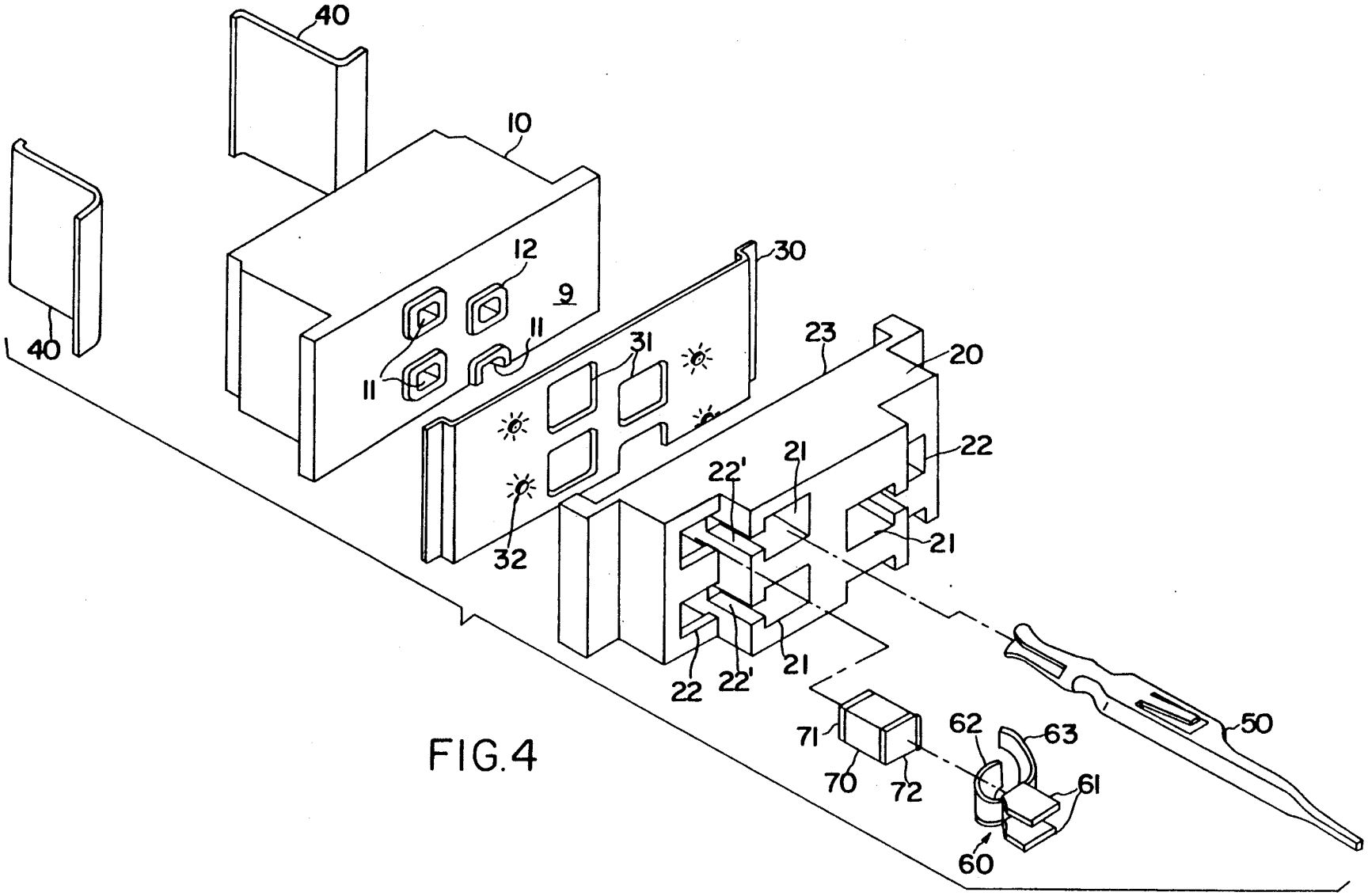
FIG. 4 is a perspective view of an alternate embodiment according to the present invention.

The configuration of the conductive member 60 also advantageously provides a mans for preventing the transmission of torsional forces or rotational movement between the contact 50 and chip capacitor or other electrical component 70. As shown in FIGS. 1 and 4, each chip component 70 is disposed in a parallel spaced relation with an associated contact 50, the only electrical and mechanical connection between these two elements being the electrically conductive member 60. This further reduces the 18 possibility of transmitting rotational movement from the contact 50 to the chip 70.

Conductive member 60 may be considered as being configured as two generally "U" shaped portions joined transversely with respect to one another at a common base. These form first and second pairs of planar surfaces joined at a common base. That is, a first horizontally extending outer surface 63 of the first "U" shaped portion contained wholly within the passageway 22 and is extends through the opening 22' between passageways 21 and 22 and is disposed against an adjacent parallel surface of a contact 50 resident in passageway 21. The second outer surface 62 of the first "U" shaped portion is disposed resiliently against an electrode surface 72 of the electrical component 70 and is bent such that the second surface 62 forms another or third "U" shaped surface butted resiliently against the electrode surface 72. The second surface 62 thus is oriented obliquely to the first surface 63 that is contained partly in passageway 21 and partly in passageway 22. The parallel outer surfaces 61 of the second "U" shaped portion that share a common base with the first "U" shaped portion are oriented transversely to the outer surfaces 62 and 63. The surfaces 61 extend outwardly and impinge resiliently against opposite sides of the passageways 22 to confront steps 221. Surfaces 61 provide a means for completely stabilizing the conducting member 60 against rotational forces of the contact 50. Because component 70 contacts surface 62 of conducting member 60 only at an end surface 72 in a resilient, non-bonded manner, no rotational movement or torsional forces are transmitted from the contact 50 to the component 70.

It will be appreciated that there is no direct contact between the chip capacitor 70 and the electrical contact 50. This has the advantage over the prior art of completely eliminating damage to the delicate chip capacitor or eliminating improper operation of the chip capacitor 70 or other chip component by reason of any axial movement of the contact 50. That is, while the electrical communication between the grounding plate 30, chip capacitor 70 and contact 50 is maximized by conductive member 60, the danger of axial movement or torsional stress applied to the chip capacitor 70 by axial movement of the contact 50 is completely eliminated.

Referring again to FIG. 3, the front portion 23 of rear insulator 20 further conformably confronts electrically insulative flange 12 of front insulator 10. It will be appreciated that this has the advantage of completely insulating the dielectric sides of chip capacitor 70 and ensures that only the electrode ends 71 and 72 of chip capacitor 70 are in contact with the grounding plate 30 and contact 50, respectively. This configuration of the insulative flange 12 in contact with portion 23 of rear insulator 20 also has the advantage of enhancing capacitor performance by preventing the formation of stray capacitances or leakage currents between the sides of capacitor and the grounding plate or contact.

This aspect of the present invention is believed to provide a significant advantage over prior art connectors wherein a delicate filtering component such as a chip capacitor must be soldered, bonded or otherwise fixedly attached to the contact itself. Additionally, the conductive member 60 ensures that there is no direct transmission of torsional forces between the contact and a delicate chip component. That is, the configuration of conductive member 60 completely eliminates any possible negative effect on operation of the chip capacitor 70 which may be anticipated by even a slight axial movement of the contact 50.

In summary, the conductive member 60 has several advantages over the prior art. It provides an extremely efficient method both from a time and cost standpoint of enabling a chip capacitor or other filter component to be freely inserted in a connector and held in an invariant and maximized electrical communication with a grounding plate and with a contact without soldering, bonding or laser welding. Accordingly, it is adapted to provide a flexible manufacturing system which enables a semi-finished connector assembly to be stored in inventory and easily configured at a later date in accordance with a customer's precise specifications.

In the prior art, electrical components such as filtering capacitors which are soldered directly to the contacts or otherwise are disposed in a transverse direct contacting relationship with the contact are subject to severe stain or deformation as a result of vibration or applied compressive or torsional forces which are transmitted directly through the contact. Capacitors may even be damaged when contacts are improperly inserted into the passageways of prior art connectors. The problem of strain or damage due to deformation is especially significant when a small and delicate component such as a chip capacitor must be precisely aligned in order to provide good electrical contact. The present invention completely eliminates the problems of strain and damage to delicate chip components due to axial movement of the contact.

In accordance with another aspect of this invention, it provides a flexible manufacturing system for enabling a separate assembling of an initial "connector assembly" and a final customer configuration of a connector in accordance with each customer's own unique design specifications. The flexible manufacturing and assembly procedure may be considered a two-stage process. Initially, the connector assembly is formed as a semi-finished product which may be stored in inventory. Secondly, in accordance with a customer's design specifications, various chip components and connectors simply may be selectively inserted into the connector assembly in a predetermined configuration in order to provide a completely manufactured connector having a configuration which may be precisely determined by the customer. The second stage of customer configuration is accomplished simply and inexpensively from inventory components without the need for bonding, welding or soldering.

The assembly procedure for the connector of the present invention is described as follows.

(1) The grounding plate 30 is positioned onto the rear side 9 of front insulator 10 so that the flange 12 project through the apertures 31.

(2) The rear insulator 20 is bonded by any suitable adhesive or bonding means to the grounding plate 30 and thus to the front insulator 10 to form an intermediate "Insert Assembly".

(3) The shield 40 is positioned on the rear side of the Insert Assembly, that is, onto front insulator 10.

(4) The shield 41 is then positioned onto the rear side of the Insert Assembly, that is, onto the sides of rear insulator 20.

(5) Tabs 401 (see FIG. 2B) of the front shield 40 are then bent down to overlap the rear shield 41 so as to secure the rear shield 41 to the front shield 40 and thus form a "Connector Assembly".

(6) As shown in FIG. 2B, a suitable fastening means or attachment means such as nut and bolt assembly 411 are provided in mounting holes and locked together to further secure the front shield 40 and rear shield 41. This completes the formation of a "Connector Assembly".

The Connector Assembly is deemed the semi-finished product of the flexible manufacturing system. The Connector Assembly is stored in inventory for subsequent customer configuration in accordance with a customer's unique design specifications.

When the manufacturer receives instructions from the customer concerning the precise configuration of the connector, the following steps are followed consecutively in producing the customized connector from the semi-finished product.

(7) A specified chip capacitor 70 or other filter component is inserted into the selected passageways 22 in the rear insulator 20.

(8) Conductive members 60 are then inserted into the selected passageways 22 until the electrode end 71 of he capacitor 70 touches a corresponding embossment 32 of the grounding plate 30. When this occurs, the projections 61 pass the steps 221 of the passageway 22 and spring out to confront the steps 221 rearwardly. This fixedly retains the chip capacitor 70 or other component without welding or bonding and provides a substantially invariant and maximized electrical communication between the grounding plate 30 and contact 50 through the resilient extension 63 which bears resiliently and conductively on contact 50 when inserted into the passageway 21. The conductive member 60 also advantageously provides a means for eliminating the transmission of torsional forces from the contact 50 and thus prevents damage and improper operation to be anticipated even by a slight possible axial movement of the contact 50 as set forth above.

(9) Contacts 50 are then inserted into passageways 21 of rear insulator 20 such that a first end portion of each contact rests conformably within a corresponding passageway 11 of front insulator 10. When each contact 50 reaches its designated position, the protrusions 51 of contact 50 will resiliently spring outward simultaneously to confront the steps 211 to prevent any rearward movement. The protrusions 52 will forwardly confront steps 212 and laterally projecting extension portion 63 of conductive member 60 will press resiliently against the associated side of contact 50 through the opening 22' between passageways 21 and 22. Thus, contact 50 is retained solidly in the passageways 11, 21.

Upon insertion of the contacts 50 in step 9 above, the product is completely finished.

In an alternate embodiment as shown in FIGS. 4 and 4A, it will be appreciated that the conductive shield 40 may be disposed only on the front insulator 10 rather than over both insulators. In this embodiment, the shape of the sides of rear insulator 20 and end portions of grounding plate 30 may be slightly altered as shown in FIG. 4 in order for grounding plate 30 to completely engage with the front shield 40 instead of the rear shield 41.

In the embodiment shown, the sides of rear insulator 20 are extended so as to cover the ends of both the front shield 40 and grounding plate 30. This shields the grounding plate 30 and front shield 40 from the ambient environment and provides an improved shielding effect from stray electromagnetic interference.

It will be appreciated that the first passageways 21 and 11 of the rear insulator 20 and front insulator 10, respectively, enable the contact 50 to be inserted in an "upside down" position therein because the structure of both passageways are symmetric at both the left and right sides. It may be convenient to insert the contact 50 in an inverse direction because the contacts of two rows are opposite to each other in the solder type cup connectors but are identical in a right angle type connector.

Further, it will be appreciated that the chip capacitor 70 may be replaced by any other type of chip component, for example, resistors, varistors, diodes or the like. The invention also can replace some versatile components which originally may be mounted on a surface of a PC board, while maintaining the same function in the operation of an entire system.

As shown in FIG. 1, it will be appreciated that passageway 22 has an opening on the front side as well as the front surface of rear insulator 20. Each second passageway 22 has a receiving end including an opening extending through the outer side of the insulator 20. This has the advantage of enabling the passageway 22 to accommodate a wide variety of chip components.

The structure of the connector according to the present invention enables any number of passageways to be provided in the front or rear insulators. Four passageways are shown merely for the sake of illustration.

In conclusion, the details of the present invention provide a flexible manufacturing system wherein a producer need not store a great number of various types of connectors as inventory. The invention shortens the lead time necessary for customizing a connector because the connector may be manufactured as a semi-finished product in accordance with the flexible manufacturing system described herein. When the manufacturer has received a customer's order, the semi-finished product may be configured in accordance with a customer's exact design specification merely by inserting the contact and capacitors or other desired chip components into corresponding passageways to provide a final product. This results in an extremely efficient method of flexible manufacturing both from a time and cost standpoint for configuring the final product.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims. For example, a separate rear insulator may be provided in order to enable different types of connectors to be configured, such as right angle type connectors, solder cup type connectors, or the like. The other elements need not be changed in order to provide these additional configurations. This is an advantage of the so called flexible manufacturing system provided by the present invention.

Therefore, persons of ordinary skill in this field are to understand that all such equivalent structures are to be included within the scope of the following claims:

What is claimed is:

1. A user configurable integrated electrical connector assembly comprising:

an insulator body defining a plurality of first passageways extending therethrough wherein said insulator body includes a front insulator and a rear insulator and said first passageways extend through both front and rear insulators;

a ground plate disposed between said front insulator and said rear insulator and transversely perpendicular to said first passageways and having a plurality of openings therein corresponding to said first passageways;

a plurality of second passageways defined only within said rear insulator and disposed in parallel with said first passageways, each second passageway having along a portion of its length a communicating opening with an adjacent first passageway and each second passageway having a receiving end including an opening extending through an outer side of said rear insulator to the exterior of said connector assembly;

a conductive shield covering said insulator body and coupled to said ground plate;

a plurality of electrical components inserted into the receiving end opening of selected ones of said second passageways after said front and rear insulators are assembled together;

a plurality of contacts inserted into corresponding adjacent first passageways; and a plurality of electrically conductive members adapted for selective insertion into selected ones of said second passageways through said receiving and openings and resiliently and electrically conductively connecting said electrical components with said associated contacts for providing a user configurable connector.

2. The connector assembly according to claim 1 wherein each of said first passageways in said rear insulator is provided with at least one step for proper positioning of the contact inserted therein.

3. The connector assembly as described in claim 2 wherein each of said second passageways in said rear insulator has at least one step therein for engagement by said electrically conductive member for proper positioning of said electrical component.

4. The connector assembly as described in claim 2 wherein a pair of spaced steps are provided, and said contact is characterized by a cylindrical first end portion and a square second end portion, said square second end portion having thereon at least one rearwardly extending resilient angular protrusion and having at least one forwardly extending angular protrusion for confronting said pair of spaced steps.

5. The connector assembly as described in claim 3 wherein said electrically conductive member is characterized by a first and second pair of surfaces extending outwardly "U" shaped from a common base, said first pair of surfaces oriented transversely along a central longitudinal axis with respect to said second pair of surfaces.

6. The connector assembly as described in claim 5 wherein said electrically conductive member is characterized by a right angle-like side configuration, a "U" shaped portion formed at an end thereof, and a horizontal extension portion formed at the opposite end thereof, and a pair of projections extending integrally rearwardly and outwardly from opposite side edges of said right angle-like side configuration.

7. The connector assembly as described in claim 6 further comprising means for preventing transmission of torsional forces to said electrical component from an associated contact and comprising a surface of said horizontal extension resiliently pressing against the associated side of said contact and an obliquely opposed surface of said "U" shaped portion disposed resiliently against a surface of said electrical component such that rotational movement, torsional forces or the like applied to said contact are absorbed by said means and are prevented from affecting said electrical component.

8. A user configurable integrated electrical connector assembly comprising:

an insulator defining a plurality of first passageways extending therethrough;

a ground plate disposed transversely through said insulator perpendicular to said first passageways and having a plurality of openings therein corresponding to said first passageways;

a plurality of second passageways defined within said insulator and disposed in parallel with said first passageways, each second passageway having a communicating opening with an adjacent first passageway along a portion of the length of said second passageway, and each said second passageway having a receiving end including an opening extending through an outer side of said insulator to the exterior of said connector;

a conductive shield covering said insulator and electrically coupled with said ground plate;

a plurality of contacts selectively insertable into corresponding adjacent first passageways; and a plurality of electrical components and a corresponding number of electrically conductive members adapted for selected insertion into selected ones of said receiving end openings of said selected second passageways after assembly of the remainder of said connector assembly for providing a user configurable connector assembly wherein said electrical components and electrically conductive members are selectively insertable in accordance with a user's requirements.

9. The connector assembly as described in claim 8 wherein said insulator includes a front insulator portion and a rear insulator portion, each having a longitudinal axis parallel to said passageways.

10. A user configurable integrated electrical connector assembly comprising:

an insulator body defining a plurality of first passageways extending therethrough wherein said insulator body includes a front insulator and a rear insulator;

a ground plate disposed between said front insulator and said rear insulator and transversely to said first passageways and having a plurality of openings therein corresponding to said first passageways;

a plurality of second passageways defined within said insulator and disposed in parallel with said first passageways, each second passageway having along a portion of its length a communicating opening with an adjacent first passageway and each second passageway having a receiving end including an opening extending through an outer side of said insulator;

a conductive shield covering said insulator body and coupled to said ground plate;

a plurality of electrical components inserted into the receiving end of selected ones of said second passageways;

a plurality of contacts inserted into corresponding adjacent first passageways;

a plurality of electrically conductive members adapted for selective insertion into selected ones of said openings of said selected second passageways for providing a user configurable connector;

each of said first passageways in said rear insulator being provided with at least one step for proper positioning of said contacts inserted therein;

each of said second passageways in said rear insulator having at least one step therein for proper positioning of said electrical component; and said ground plate has a plurality of embossments on a surface thereof facing said second passageways.

11. The connector assembly as described in claim 10 wherein said front insulator has a plurality of integral flanges for conformably mating with said openings of said grounding plate corresponding to said first passageways.

12. The connector assembly as described in claim 10 wherein said conductive shield includes a front shield and a rear shield electrically coupled with said ground plate and covering said front insulator and said rear insulator, respectively.

* * * * *